United States Patent [19]

Best et al.

[11] Patent Number: 4,655,059

[45] **Date of Patent: * Apr. 7, 1987**

[54] LEVER HANDLE

[75] Inventors: Walter E. Best; William R. Foshee, both of Indianapolis, Ind.

[73] Assignee: Best Lock Corporation, Indianapolis, Ind.

[ * ] Notice: The portion of the term of this patent subsequent to Jul. 26, 2000 has been disclaimed.

[21] Appl. No.: 503,769

[22] Filed: Jun. 13, 1983

Related U.S. Application Data

[63] Continuation-in-part of Ser. No. 270,825, Jun. 5, 1981, Pat. No. 4,394,821, which is a continuation-in-part of Ser. No. 136,746, Apr. 2, 1980, abandoned.

[51] Int. Cl.[4] ..... E05C 13/00

[52] U.S. Cl. ..... 70/224; 292/347

[58] Field of Search ..... 70/224, 422, 417; 292/336.3, 347, 348, 352, 353, DIG. 2

[56] References Cited

U.S. PATENT DOCUMENTS

| | | | |
|---|---|---|---|
| 738,503 | 9/1903 | Waters | 292/353 X |
| 3,827,739 | 8/1974 | Overholser | 292/347 |
| 4,052,868 | 10/1977 | Best et al. | 292/352 X |
| 4,062,579 | 12/1977 | Potter et al. | 292/348 |
| 4,195,502 | 4/1980 | Best et al. | 72/224 |
| 4,222,253 | 9/1980 | Peitsmeier | 70/417 |
| 4,326,738 | 4/1982 | Loftus et al. | 292/336.3 X |
| 4,342,478 | 8/1982 | Foshee | 292/352 |
| 4,394,821 | 7/1983 | Best et al. | 70/224 X |
| 4,397,489 | 8/1983 | Lind | 292/347 |

*Primary Examiner*—Robert L. Wolfe
*Assistant Examiner*—Russell W. Illich
*Attorney, Agent, or Firm*—Barnes and Thornburg

[57] ABSTRACT

A keyed lever handle for a cylindrical lock comprises a handle body which is rotatably mounted by its neck on the knob sleeve of the lock and is removably held by a retainer and is connected for rotation with the sleeve by a driver which releases under excess torque, either yieldingly or by break-away of a driver lug. An outward-extending body shell telescopically receives and supports an outer handle shell integral with a handle lever. The outer shell has an inward-extending end flange spaced from the end face of the body shell to define therebetween an inward-opening groove which receives a retainer for an end face closure mounted in the cylindrical open end of the assembled shells. The retainer may be a separate snap ring or an integral flange on the closure. The closure member receives a key-operated and removable core, and its rotative mounting permits different orientations to suit the hand of the door, and also permits the lever handle to rotate when drive is released under excess torque.

21 Claims, 6 Drawing Figures

LEVER HANDLE

This application is a continuation-in-part of our co-pending application Ser. No. 06/270,825, filed June 5, 1981, which was a continuation-in-part of application Ser. No. 06/136,746, filed Apr. 2, 1980, and now abandoned.

This invention relates to door handles, and especially to lever handles for cylindrical locks, to replace the round knobs normally used on such locks.

A number of situations exist where it is desirable or mandatory to provide a lever handle on door locks to ensure that the locks are operable by persons such as handicapped persons who have difficulty operating a knob which can be turned only by tightly gripping the knob. In the past, difficulties have been encountered in providing lever handles on cylindrical locks having key-operable mechanisms in the handles, especially since lever handles permit the exertion of high torque on the handle sufficient to damage the cylindrical lock mechanism or to override the key-operable mechanism of the lock and thus to jeopardize its security. Also, the handle lever unbalances the handle and tends to rotate the handle and interfere with the locking mechanism and make it difficult to lock the mechanism by key or inside button. The present invention provides a lever handle adapted to replace a round knob, and especially to replace the knob of a cylindrical lock of the type shown in our co-pending application Serial No. 06/270,825, filed June 5, 1981, while retaining and utilizing many of the standard parts and advantages of that cylindrical lock, particularly the torque-releasable feature thereof and the provisions for easily changing the hand of the lock to adapt it for mounting on doors of different hand.

In accordance with the invention, the door handle comprises an inner hollow body having a neck portion adapted to be mounted on a knob sleeve or the like which is rotatable to actuate a cylindrical lock such as the lock shown in said application, and adapted to be retained on and drivingly connected to the knob sleeve in a similar manner so as to permit use of standard parts used in such cylindrical lock. The hollow body also has an outward body shell that terminates at a circular end face surrounding a large circular body opening. An outer shell is telescopically received over such body shell, is pinned or otherwise fixed thereto, and has an end flange which defines a circular opening and which extends radially inward in spaced relation with the end face of the body shell so as to define therewith an inward-opening circumferential groove. An end closure member is received within the end opening formed by said shells, and in a key-operated handle contains or is adapted to contain a key-removable core or analogous key-operated lock mechanism. The end closure member is secured in assembled, and preferably rotatable, relation with the assembled shells by means engaged in said inward-opening circumferential groove.

The knob assembly is retained on the knob sleeve by a knob keeper mounted in the knob sleeve and is driven by a driver mounted in the knob sleeve and engaged in an axial groove or recess in the side face of the neck. The driver may engage the neck positively so as to provide a positive drive between the knob sleeve and lever handle, but preferably provides a releasable connection to prevent the transmission to the lock mechanism of excessive torque applied to the lever handle.

The releasable connection may be one in which the driver is yieldingly biased to an engaged position but is cammed to a retracted position in the presence of excessive torque, substantially as disclosed in said co-pending application. Alternatively, the driver may be positively engaged with the handle neck but provided with a break-away lug portion which breaks away under such excessive torque The driving connection between the driver and neck is desirably such that the driver engages such neck in only one position of orientation of the lever handle so that such lever handle will always extend toward the hinged edge of the door in which the lock mechanism is mounted and cannot extend in the opposite direction past the free edge of the door. As in our co-pending application, change of hand of the lock mechanism may be accomplished by removing the lock core, rotating the end closure member to an opposite position, and reinserting the core in an opposite orientation.

The accompanying drawings illustrate the invention and show embodiments exemplifying the best mode of carrying out the invention as presently perceived. In such drawings.

Figure 1:
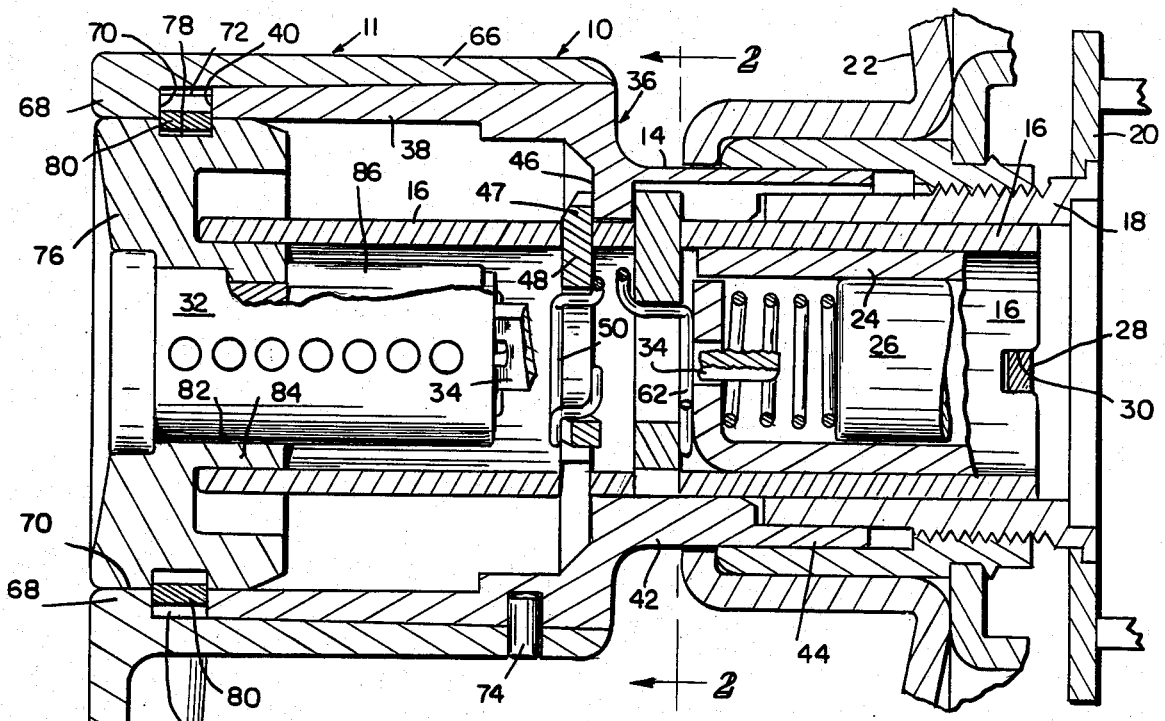
FIG. 1 is a horizontal axial section of a cylindrical lock mechanism in accordance with the invention.
Figure 2:
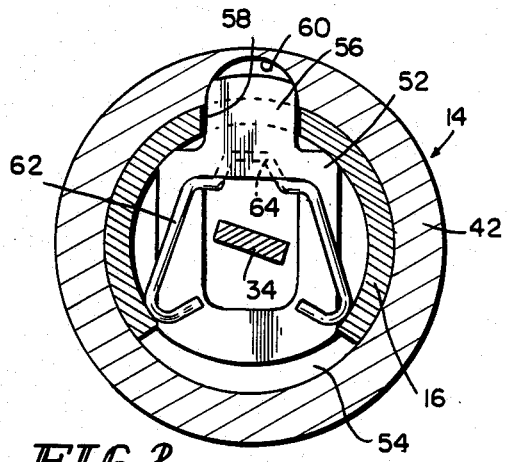
FIG. 2 is a section taken on the line 2—2 of FIG. 1 and showing a knob driver adapted to be cammed to a retracted position in the presence of excessive torque on the knob assembly.

The lock mechanism shown in FIGS. 1 and 2 comprises a door handle 10 having an outer hand-hold portion which carries a handle lever 12 and has a neck portion 14 by which it is mounted on a generally cylindrical knob sleeve 16. The sleeve is mounted for rotation in a hub 18 fixed to a chassis side plate 20 of a cylindrical lock mechanism, as more fully shown in U.S. Pat. No. 3,955,387. As there shown, the inner end of the knob sleeve 16 carries a roll-back cam (110 in such patent) adapted to engage a retractor for retracting the bolt of the door. A trim ring assembly 22 is threaded on the outside of the hub 20 and extends outward into overlapping relation with the neck portion 14. A key-actuated roll-back cam sleeve 24 is rotatably mounted within the knob sleeve 16 and carries at its inner end a second roll-back cam corresponding to the cam 114 in U.S. Pat. No. 3,955,387. For convenience of illustration, the roll-back cams are not shown in FIG. 1. Also, in this and other aspects, the showing in FIG. 1 may be considered somewhat diagrammatic in that certain parts are shown in a rotational orientation different from that they may take in the actual lock mechanism.

For purposes of locking the knob sleeve 16 against rotation and thus to limit lock actuation to that provided by key actuation of the cam sleeve 24, a locking lug bushing 26 (122 in the patent) is slidably mounted within the roll-back cam sleeve 24. This carries at its inner end a locking lug 28 which in its normal position extends radially from the bushing 26 outward across the end face of the knob sleeve 16 and into a notch in the hub, as more fully shown in said patent. The bushing is adapted to be moved inward against its biasing spring, as by a thumbpiece on the associated inside knob, to carry the locking lug 28 into a notch 30 in the end of the knob sleeve 16 so as to lock such knob sleeve 16 against rotation relative to the hub 18. When the knob sleeve is thus locked against rotation, the lock mechanism may be operated by a key-operated core 32 mounted in the handle 10 as more fully explained below. The core 32 is connected by a throw member 34 to the key-actuated cam sleeve 24.

In accordance with the present invention, the handle 10 comprises a hollow body 36 which at its inner end forms the neck 14 of the handle and which has an outward-extending body shell portion 38, conveniently of cylindrical shape and having at its outer end a flat end face 40. The inner face of the body shell is desirably cylindrical and defines a circular end opening.

The neck portion 14 of the hollow body 36 includes a relatively thick cylindrical portion 42 in rotative bearing engagement with the outer surface of the sleeve 16. Inward beyond such thick portion 42, the neck has a thinner portion 4 which is telescopically received between the trim ring assembly 22 and the outer end of the hub 18.

For purposes of retaining the handle 10 on the knob sleeve 16, the knob body 36 is formed with a circumferentially continuous radial face 46 at the outer end of the thick portion 42. Such face is engaged by a projecting lug 47 on a retainer 48 mounted for radial movement in cross slots in the knob sleeve 16, and biased to engaged position by a biasing spring 50, as more fully shown in co-pending application Ser. No. 06/270,825.

In the embodiment of FIGS. 1 and 2, a drive connection between the handle and the knob sleeve 16 is formed by a torque-releasable driver 52 in the form of a generally rectangular plate engaged at one end in a slot 54 in the knob sleeve 16 and having a drive lug 56 at its opposite end extending through a diametrically opposite slot 58 in the knob sleeve. The driver 52 has a central opening to clear the throw member 34. The drive lug 56 is formed with a rounded end which engages in a groove 60 formed in the thick section 42 of the handle neck 14. Such groove 60 extends axially to the inner end of the neck 14 so as to permit the handle to be assembled axially over the driver 52. In this modification, the driver 52 is biased to an engaged position by a biasing spring 62 having a bight 64 engaged in the central opening in the driver 52 and having side legs in camming relation with the opposite inner surface of the cylindrical knob sleeve 16. As more fully explained in co-pending application Ser. No. 270,825, the application of excessive torque on the handle will cause the driver 52 to be cammed inward to a release position in which the handle will be free to rotate relative to the knob sleeve and its associated lock mechanism, so as to prevent such excess torque from actuating or damaging such mechanism.

The outward cylindrical shell portion 38 of the handle body 36 is telescopically received within a cylindrical shell 66 which extends from the rear of such body shell 38 forward past the end face 40. At its forward end, such outer shell 66 is formed with an inward-extending flange 68 desirably having an inner cylindrical surface aligned with the inner cylindrical surface of the body shell 38. Such flange 68 has an inward end face 70 in spaced relation to the end face 40 of the body shell 38, so as to define therebetween a radially inward-opening circumferential groove 72 for the purposes described below.

The handle lever 12 is integral with the outer shell 66, and such shell 66 is fixed to the body 36 by a press-in pin 74, which is finished off flush with the surface of the shell 66, desirably located in the same plane with the handle lever 12.

The end opening defined by the inner faces of the flange 68 and the body shell 38 is closed by an end face closure member 76. This has an outer cylindrical surface which makes rotative bearing engagement with the inner surfaces of the flange 68 and body shell 38, and is formed with an outward-opening groove 78 in registry with the groove 72 between the opposing end faces 40 and 70 of the body shell and flange 68. The face closure member is rotatably locked in place by a buried ring 80 which has portions engaged in each of the grooves 72 and 78. In assembly, the ring is mounted in the groove 78 of the face closure member, such member is placed in the open end of the inner shell 38, and the outer shell is then placed over the resulting subassembly so as to trap the ring in the groove 72.

In the embodiment shown, the face closure member 76 is formed with a figure-8 opening 82 for the reception of the key-operated core 32. Such core has a key plug lobe and a pin tumbler lobe, and the face closure opening 82 is formed to position the key plug lobe coaxially with the handle body 36 and knob sleeve 16. Such lobe contains a key plug connected to the throw member 34 so that key operation of the key plug will rotate the throw member 34 to actuate the cam member 24 for retracting the latch bolt of the lock mechanism.

Desirably, the face closure member 76 is formed with a rearward-extending circular flange 84 which is interrupted to pass the pin tumbler lobe of the core 32 and which has a rear face adapted to be engaged by a retainer lug 86 on the core 32. Such flange 84 also engages within forward-extending portions of the knob sleeve 16 to stabilize the outward end of the handle 11.

To permit insertion of the core 32, the forward end of the knob sleeve is cut away to form diametrically opposite slots adapted to pass the pin tumbler lobe of the core in either of two opposite locations, and such slots are located so that the core will be in a vertical position when the lock mechanism is installed in a door. The two opposite positions of the slots permit the lock mechanism to be installed in doors of either hand, and in each such installation to permit the core to be mounted in an upright position, with the pin tumbler lobe above the centered key plug lobe. To change from one hand to the other, the core 32 is removed from the assembly, the face closure member 76 is then rotated to position its figure-8 opening 82 with its pin tumbler-receiving portion above its centered key plug-receiving portion, and the core is reinstalled in upright position. The rotative mounting of the face closure member 76 in the end opening of the handle assembly readily permits this change to suit installation of the lock mechanism in doors of either hand, and the change can be made without disassembly of the knob mechanism except for removal of the key-removable core.

This same rotative mounting of the face closure member 76 interacts with the torque-releasable drive connection between the handle and knob sleeve 16, which releases the handle from driving connection with the knob sleeve when excessive torque is applied to the handle. The core 32 remains engaged with the knob sleeve 16 and locks the face closure member 76 against rotation relative to that knob sleeve. But the rotatable mounting of the face closure member in the handle permits the handle to rotate relative to the face closure member and hence relative to the core in the knob sleeve when excessive torque overrides the torque-releasable drive connection between the handle and the knob sleeve. When such drive connection is interrupted, the handle and its neck are free to rotate relative to the knob sleeve. Normal drive connection is re-established as soon as the handle is rotated to its normal position in which the groove 60 of the knob body 36 comes back into alignment with the drive lug 56 of the driver 52. There is only one such groove 60 in a lock mechanism in which the handle includes a handle lever 12, and the arrangement is such that when the drive is established between the drive lug 56 and the groove 60, the handle lever 12 will be in a horizontal or other desired position.

Figure 3:
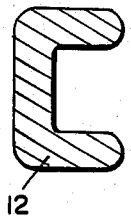
FIG. 3 is a section taken on the line 3—3 of FIG. 1.

The handle of FIGS. 1–3 may be assembled by first assembling a ring 80 in the groove 72 of a face closure member 76, inserting such member in the open end of the inner body shell 38, then sliding the outer knob shell 66 over the resulting subassembly, and then fixing the two shells together by press-fitting a pin 74 in a hole drilled into the two shells. The ring 80 lies partially in each of the grooves 72 and 78 to lock the closure member in axially fixed rotatable relation in the knob assembly.

Figure 6:
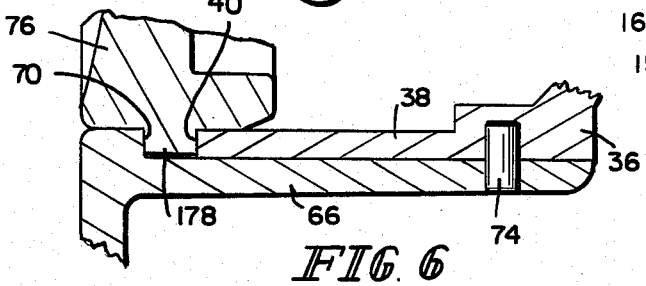
FIG. 6 is a partial section showing a modification of FIG. 1 in the face closure is retained by an integral flange.

In the modification of FIG. 6, the closure member 76, instead of having a peripheral groove 78, is formed with a peripheral radial flange 178 adapted to fit in the groove 72 between the end face 40 of the inner body shell 38 and the inward side face 70 of the flange 68 of the outer knob shell 66. The knob is assembled by first positioning the end closure member in one or the other of the two shells, and then assembling the shells with the flange 178 trapped between them. The pin 74 is then inserted to fix them together, with the end closure member 76 in place.

Figure 5:
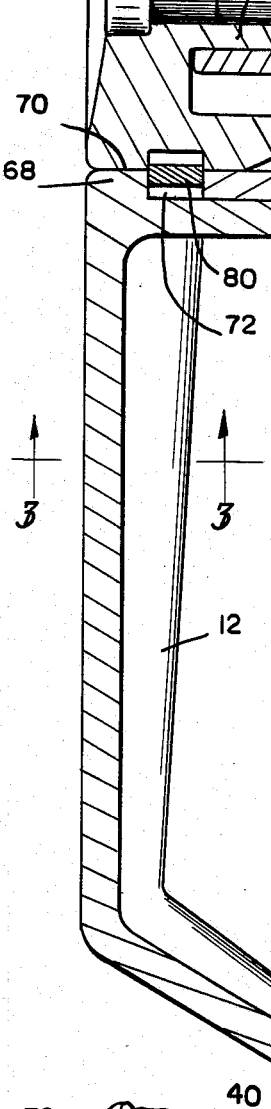
FIG. 5 is a section taken on the line 5—5 of FIG. 4.
Figure 5:
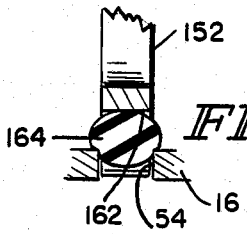
Figure 4:
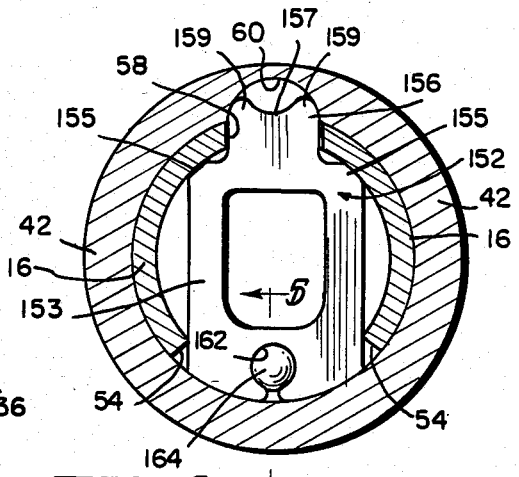
FIG. 4 is a sectional view similar to FIG. 2 but showing a driver which is positively held against retraction and in which the knob-driving lug is weakened so as to break away under excessive torque applied to the knob assembly.

In the modification shown in FIGS. 4 and 5, the torque-releasable driver 52 is replaced by a positive driver 152. This has a generally rectangular body portion 153 which is insertable through and is engaged in the slot 54 at the bottom of the knob sleeve 16. At its opposite end, the driver 152 carries a driving lug 156 which extends through an opposite narrower slot 58 in the knob sleeve. The central body has side shoulders 155 engaged against the inner face of the knob sleeve. The drive lug 156 engages in the groove 60 in the heavy wall 42 of the handle body 14 to provide a positive drive between the handle and the knob sleeve. To prevent excessive torque from being transmitted between the lever handle 10 and the knob sleeve, the drive lug 156 is weakened so as to break away when excessive torque is applied to the lever handle and then to allow that handle to rotate about the knob sleeve.

In the arrangement shown, the lug 156 is formed with an end recess 157 which leaves two upstanding ears 159 at its sides which are designed to break away in the event excessive torque is applied to the handle. To this end, the driver 152 is made of such material and the ears 159 have such a cross section that under excessive torque the lug 156 will break away in the shear plane between the handle body portion 42 and the knob sleeve 16 and will thus prevent the excess torque from being transmitted to the lock mechanism. In a particular embodiment, the driver was a low-density powdered metal part, such that the ears 159 would break away under a torque of approximately 300 foot-pounds.

The driver 152 extends diametrically across the knob sleeve and has its opposite end in abutting relationship with the surrounding body portion 42 so that it is trapped in place when the parts are in assembled operating condition. For purposes of retaining the driver in place in the knob sleeve when no handle body 36 is present, the driver is formed with an opening 162 which intersects the inside surface of the knob sleeve 16, and a rubber ball 164 or other elastic element is press-fitted in such opening. The ball resiliently engages the side edges of the slot 54, as indicated in FIG. 5, so as to retain the driver in place. In the event the driver lug 156 is broken away, the driver is readily removed and replaced by first removing the knob to expose the broken driver, pressing such driver out of the knob sleeve, and inserting a new driver 152 and ball 162.

The present invention provides a lever handle for a cylindrical lock set which is interchangeable with a knob of conventional shape as shown in co-pending application Ser. No. 270,825 and which permits the use of lock mechanism of standard construction used in various functions for which the lock mechanism of that application is adapted. The lever handle is of simple andction used in various functions for which the lock mechanism of that application is adapted. The lever handle is of simple and advantageous construction, and indeed is in some respects less troublesome and expensive to manufacture than the knobs of such application. Thus, the body 36 of the lever handle can be manufactured of bar or tube stock by simple turning operations and plunge-cut boring operations without the necessity for any undercuts. Similarly, the knob or outer shell 66 and its integral handle lever 12 can be formed as a casting which requires little or no machining. Its assembly provides the desired inward-opening circumferential groove 72, and the two parts are secured together by a simple pin 74 pressed into a suitable drilled hole extending through the shell 66 into the body 36. The arrangement provides the advantages of protection against excess torque, which is of special significance because of the high torque which can be exerted on the lever handle. It also provides the advantages of the co-pending application in permitting the lock set to be installed in doors of either hand without modification and adopted for each such installation by simply orienting the face closure member 76 to take the key-removable core 32 in an upright position in the particular installation.

What is claimed is:

1. A door handle adapted to contain a key-operated lock mechanism comprising a hollow body having a neck adapted to be mounted on a knob sleeve or the like and having an outward-extending body shell terminating at a circular eend face surrounding a circular body opening, an outer shell telescopically received over said body shell, fixed thereto, and having an end flange defining a circular opening, said flange being axially spaced from said end face of the body shell and defining therewith an inward-opening circumferential groove, means for rigidly interconnecting the body shell and the outer shell, an end closure member rotatably received within the end opening formed by said rigidly interconnected shells and containing or adapted to conain key-operated lock mechanism, and means engaged in said inward-opening circumferential groove for securing said end closure member in axially fixed rotatable relation with said assembled rigidly interconnected shells.

2. A door handle as in claim 1 in which said closure member contains a groove in registry with said inward-opening circumferential groove, and said means for securing said closure member comprises a buried ring engaged in both such grooves.

3. A door handle as in claim 1 in which said means for securing said closure member comprising a flange intergral with said closure member and received in said circumferential groove between the end face of the body shell and the flange of the outer shell.

4. A door handle as in claim 1 in which said outer shell carries a projecting handle lever.

5. A door handle as in claim 2 in which said outer shell carries a projecting handle lever.

6. Door lock mechanism comprising a door handle as in claim 4 in combination with a cylindrical knob sleeve on which the handle body is rotatably mounted, and drive connection means between the knob sleeve and the handle, including a driver mounted transversely in the knob sleeve and having a drive lug projecting radially from the knob sleeve and engaged in an inward-opening recess in the handle, said connection being releasable in response to a predetermined leverage applied to the handle lever so as to release the handle from driving relation with the knob sleeve if excessive torque is applied to the drive connection.

7. Door lock mechanism as in claim 6 in which said drive lug and handle recess are positively engaged and said drive lug is formed with a weak section adapted to shear under conditions of excessive torque.

8. Door lock mechanism as in claim 7 in which said driver is mounted in a transverse opening in the knob sleeve and blocked from retraction by a surrounding section of the handle, the handle being removable and the driver being removable from the knob sleeve and replaceable when the handle is removed from such sleeve.

9. Door lock mechanism as in claim 6 in which said drive connection means is engageable in a single orientation of the handle relative to the knob sleeve so as to position the lever handle in a predetermined orientation relative to the lock bolt and thereby to the door in either a right- or left-hand installation, the end closure member having a non-circular opening adapted to receive a removable key-operated core or the like in a single orientation and said end closure member being rotatable to opposite orientations so as to position the core in a predetermined orientation relative to the door in either hand installation of the door lock mechanism.

10. A door handle comprising a hollow body having a neck adapted to be mounted on a knob sleeve or the like and having an outward-extending cylindrical body shell terminating at a circular end face surrounding a circular body opening, an outer shell telescopically received over said body shell, fixed thereto, and having a radil end flange defining a circular opening, said flange extending inward in axially spaced relation with the end face of the body shell and defining therewith an inward-opening circumferential groove, means for rigidly interconnecting the body shell and the outer shell, an end closure member received within the end opening o said outer shell, and means engaged in said inward-opening circumferential groove for securing said end closure member in assembly said assembled rigidly interconnected shells.

11. A door handle as in claim 10 in which said closure member contains a groove in registry with said inward-opening circumferential groove, and said means for securing said closure member comprises a buried ring engaged in both such grooves.

12. A door handle as in claim 10 in which said means for securing said closure member comprises a flange integral with said closure member and received in said circumferential groove between the end face of the body shell and the flange of the outer shell.

13. A door handle as in claim 10 in which said end closure member is secured in rotatable relation with said assembled shells.

14. A door handle for use on a knob sleeve and adapted to contain a lock mechnism, the door handle comprising a hollow body having a neck adapted to be mounted on the knob sleeve and having an outwardly-extending body shell terminating at an end face, the body shell being formed to include an opening for the reception of an end closure member and the lock mechanism, the body shell opening being defined by the end face, the body shell including a first radially-inwsardly facing surface in proximity to the end face, an outer shell telescopically received over said body shell, fixed thereto, and having an end flange, the outer shell being formed to include an opening for the reception of the end closure member and the lock mechanism, the outer shell opening being defined by the end flange, the outer shell including a second radially-inwardly facing surface, the end facing of the outer shell and the end face of the body shell being in axially spaced relation to define therebetween an inwardly-opening circumferential groove for the reception of closure member securing means, an end closure member for receiving the lock mechanism, the end closure member being rotatably received in the end opening formed by the shells, the end closure member including a radially-outwardly facing surface in bearing engagement with both the first and second radially-inwardly facing surfaces of the two shells, and means, engaged in said inwardly-opening circumferential groove, for securing the end closure member in axially fixed relation with the assembled shells.

15. The door handle of claim 14, wherein the radially-outwardly facing surface of the end closure member includes an axially-inward portion in bearing engagement with the first radially-inwardly facing surface of the body shell when the end closure member is secured in its received position, and an axially-outward portion in bearing engagement with the second radially-inwardly facing surface of the outer shell when the end closure member is secured in its received position.

16. The door handle of claim 15, wherein the end closure member is formed to include an outwardly-opening circumferential groove that is registrable with the inwardly-opening circumferential groove defined by the body shell and the outer shell, the outwardly-opening circumferential groove of the end closure member being formed intermediate the axially inward and outward portions of the radially-outwardly facing surface.

17. The door handle of claim 15, wherein the end closure member is formed to include an outwardly-extending circumferential flange that is engageable with the inwardly-opening circumferential groove defined by the body shell and the outer shell, the outwardly-extending flange being formed intermediate the axially inward and outward portions of the radially-outwardly facing surface.

18. A door lock mechanism having a door handle adapted to contain a key-opered lock mechanism comprising a hollow body having a neck adapted to be mounted on a knob sleeve or the like and having an outward-extending body shell terminating at a circular end face surrounding a circular body opening, an outer shell telescopically received over said body shell, fixed thereto, and having end flange defining a circular opening, ssaid flange being axiaslly spaced from said end face of the body shell and defining therewith an inward-opening circumferential groove, the outer shell carrying a projecting handle lever, an end closure member for receiving the key-operated lock mechanism, the end closure member being rotatably received within the end opening formed by said shells, means engaged in said inward-opening circumferential groove for securing said end closure member in axially fixed rotatable relation with said assembled shells, a cylindrical knob sleeve on which the handle body is rotatably mounted, and drive connection means between the knob sleeve and the handle, the drive connection means including a driver mounted transversely in the knob sleeve and a drive lug projecting radially from the knob sleeve and engaged in an inward-opening recess in the handle, said connection being releasable in responses to a predetermined leverage applied to the handle lever so as to release the handle from driving relation with the knob sleeve if excessive torque is applied to the drive connection, and wherein the driver is yieldingly biased to a driving position and retractable to a release position and the drive lug and handle recess are formed to cam the driver to release position under conditions of excessive torque.

19. A door handle as in claim 18 in which said closure member contains a groove in registry with said inward-opening circumferential groove and said means for securing said closure member comprises a buried ring engaged in both such grooves.

20. A door handle as in claim 18 in which said means for securing said closure member comprises a flange integral with said closure member and received in said circumferential groove between the end face of the body shell and the flange of the outer shell.

21. A handle assembly for operating a lock mechanism in a door, the handle assembly comprising sleeve means for actuating the door lock mechanism, a hollow body having a neck adapted to be mounted on the sleeve means and an outward-extending body shell terminating at an end face, the body shell being formed to include an end opening for the reception of an end closure member, an outer shell telescopically received over said body shell, fixed thereto, and having an end flange and a projecting handle lever, the outer shell being formed to include and end opening for the reception of an end closure member, the outer shell opening being defined by the end flange, the end flange of the outer shell and the end face of the body shell being in axially spaced relation to define therebetween an inwardly-opening circumferential groove for the reception of closure member securing means, an end closure member for receiving a lock core, the end closure member being rotatably received within the end openings formed by the assembled shells, eceiving a lock core, the end closure member being rotatably received within the end openings formed by the assembled shells, means, engaged in said inwardly-opening circumferential groove, for securing the end closure member in axislly fixed relation within the assembled shells, and drive means for providing a releasable operating connection between the hollow body and the sleeve means, the drive means being releasable in response to a predetermined leverage applied to the handle lever so as to release the handle from driving relation with the sleeve means if excessive torque is applied to the drive connection.

* * * * *